United States Patent [19]

Hollis

[11] Patent Number: 5,071,045

[45] Date of Patent: Dec. 10, 1991

[54] PLASTIC GARMENT HANGER WITH ANGLED SHOULDER PORTION

[75] Inventor: Joseph C. Hollis, Melbourne, Australia

[73] Assignee: Spotless Plastics Pty. Ltd., Victoria, Australia

[21] Appl. No.: 490,694

[22] PCT Filed: Sep. 21, 1988

[86] PCT No.: PCT/AU88/00371

§ 371 Date: Apr. 12, 1990

§ 102(e) Date: Apr. 12, 1990

[87] PCT Pub. No.: WO89/02238

PCT Pub. Date: Mar. 23, 1989

[30] Foreign Application Priority Data

Sep. 21, 1987 [AU] Australia ..... PI4511

[51] Int. Cl.[5] ..... A47G 25/28; A47G 25/14

[52] U.S. Cl. ..... 223/92; 223/85

[58] Field of Search ..... 223/85, 88, 92, 95; D6/315, 318; 211/113

[56] References Cited

U.S. PATENT DOCUMENTS

| | | | |
|---|---|---|---|
| D. 273,072 | 3/1984 | Batts et al. | D6/318 |
| D. 283,854 | 5/1986 | Marshall | D6/318 |
| 2,906,442 | 9/1959 | McNutt | 223/94 |
| 3,477,623 | 11/1969 | Milette | 223/88 |
| 3,547,321 | 12/1970 | Crane | 223/88 |
| 4,046,293 | 9/1977 | Garrison | 223/88 |
| 4,450,639 | 5/1984 | Duester | 40/322 |
| 4,638,930 | 1/1987 | Blanchard | 223/85 |
| 4,828,155 | 5/1989 | Louw | 223/85 |
| 4,951,855 | 8/1990 | Jacobson et al. | 223/88 |

FOREIGN PATENT DOCUMENTS

| | | | |
|---|---|---|---|
| 543321 | of 1981 | Australia | 223/85 |
| 544211 | of 1983 | Australia | 223/85 |
| WO89/10718 | 11/1989 | PCT Int'l Appl. | 223/85 |

*Primary Examiner*—Werner H. Schroeder
*Assistant Examiner*—Bibhu Mohanty
*Attorney, Agent, or Firm*—Scully, Scott, Murphy & Presser

[57] ABSTRACT

A molded plastic garment hanger comprising a hook, a shoulder region extending from the hook and arms extending from said shoulder region, said arms being formed with an inverted generally U-shaped cross-section or configuration which extends from one arm to the other along a continuous or uninterrupted path which extends below transmission regions between the arms and shoulder regions, said shoulder region including a depressed region having an inverted generally U-shaped configuration extending across the shoulder region and being spaced from said cross-sectional configuration extending from one arm to the other by planar regions so that said cross-sectional configuration does not completely intersect said transition regions. The depressed region of the shoulder angles from the front plane of the hanger, to the rear plane of hanger.

7 Claims, 2 Drawing Sheets

PLASTIC GARMENT HANGER WITH ANGLED SHOULDER PORTION

FIELD OF THE INVENTION

This invention relates to improvements in moulded plastics garment hangers.

BACKGROUND OF THE INVENTION

In our Australian Patent No. 544211 (AU-B-21403/83), and U.S. Pat. No. 283,854, we describe a moulded plastics garment hanger having an improved arm cross section which significantly increases the strength of the hanger and therefore enables it to be manufactured in a manner which reduces the amount of material used in the moulding of the hanger. While such hangers have achieved significant commercial success, market requirements have developed which dictate that further increases in hanger strength must be achieved to reduce the likelihood of hanger breakages which could result in injuries to the end users of the product.

Our continuing research has shown that hangers of the type described in our above mentioned patent tend to fracture, under extreme load conditions, in the region of the transition between the shoulder of the hanger and the arm of the hanger. This area of weakness becomes noticeable when the hangers are used for heavy weight garments of the type which are sold in markets outside Australia, for example, in the northern hemisphere markets of Europe and North America. When the hanger supports a heavier type of garment, the arms of the hanger tend to bend at the transition region between the shoulder and arms and may therefore develop fractures or breakages in these regions. Such problems may in particular develop where the hanger is moulded from a less flexible material, such as general purpose polystyrene.

In most moulded plastics garment hangers, including the hanger described in our aforementioned patent, the arms are strengthened by means of channel or I-sections, or variations of such sections, such as described in our aforementioned patent. The channel or I-section usually extends along the length of the arm and through the transition region between the arms and the shoulder of the hanger. Experiments have shown that the passage of the channel section, or the extension of the I-section, through this region creates areas of weakness about which the arms tend to bend when the hanger is excessively loaded.

SUMMARY OF INVENTION AND OBJECTS

It is an object of the present invention to provide an improved moulded plastics garment hanger in which the above shortcomings are at least ameliorated.

In its broadest form, the invention provides a moulded plastics garment hanger comprising a hook, a shoulder region extending from the hook, and arms extending from said shoulder region, said arms having a cross-sectional configuration adapted to increase the strength of the arms, said cross-sectional configuration extending from one arm to the other along a continuous or interrupted path which extends below the transition region between the arms and the shoulder region, said shoulder region being moulded in a configuration which reinforces said shoulder region in a manner which does not completely intersect said transition region.

By moulding the garment hanger in the above form, the region of weakness created by the reinforcing cross section of the arms intersecting the transition region between the shoulder and the arms is avoided thereby strengthening the hanger in this vulnerable region.

In a preferred form of the invention, the moulded reinforcing means in the shoulder region of the hanger is spaced from the cross section extending from one arm to the other to leave a planar region of substantial width. In one particularly preferred embodiment, this planar region is of the order of 3 to 7 mm wide, and most preferably about 5 mm wide.

The reinforcing means in the shoulder region of the hanger includes a channel formed in an inverted generally U-shaped configuration extending across the shoulder region with the legs of the U directed towards, but having their ends spaced from, said cross section extending from one arm to the other. The spacing between the ends of the legs of the U and the said cross section is preferably as defined above.

In a particularly preferred arrangement, the base of the U-shaped channel opens into an enlarged planar region which follows the configuration of t he shoulder of the hanger up into the throat of the hook of the hanger, the floor of this region tapering gradually inwardly to a central web defining the hook of the hanger. Preferably the hook of the hanger is of a I-shaped cross section with the web terminating in transverse flanges.

The cross sectional configuration of the arms of the hanger is preferably similar to the cross sectional configuration of the arms as defined in our aforementioned patent although the configuration of the cross section is preferably reduced in thickness and formed with reduced angle of ejection. For example, the angle of ejection of the hanger according to the aforementioned patent is of the order of 8° whereas the preferred angle of ejection of the hanger according to the present invention is preferably between 2° and 5°, most preferably about 3°. This reduction in the angle of ejection causes an increase in the rigidity of the cross section which enables the reduction in thickness of the material of the cross section. Although the above described cross section is preferred, it will be appreciated that the invention is equally applicable to other reinforcing cross sections, such as a U-section, a modified U-section or an I-section:

The hanger may be moulded from any suitable material including general purpose polystyrene, K-resin, high impact polystyrene or PETG. To facilitate moulding of the hanger from PETG, which has different moulding properties to the more commonly used plastics, the hanger is preferably moulded using two moulding gates positioned adjacent the transition region between the shoulder and the arms of the hanger. This modified moulding method allows the material to flow more evenly into the mould and facilitates more rapid moulding of materials PETG.

BRIEF DESCRIPTION OF THE DRAWINGS

Two presently preferred embodiments of the invention will now be described with reference to the accompanying drawings in which.

Description of the Preferred Embodiments

Figures 1, 2, 3, 4, 5, 6, 7, 8, 9, 10:
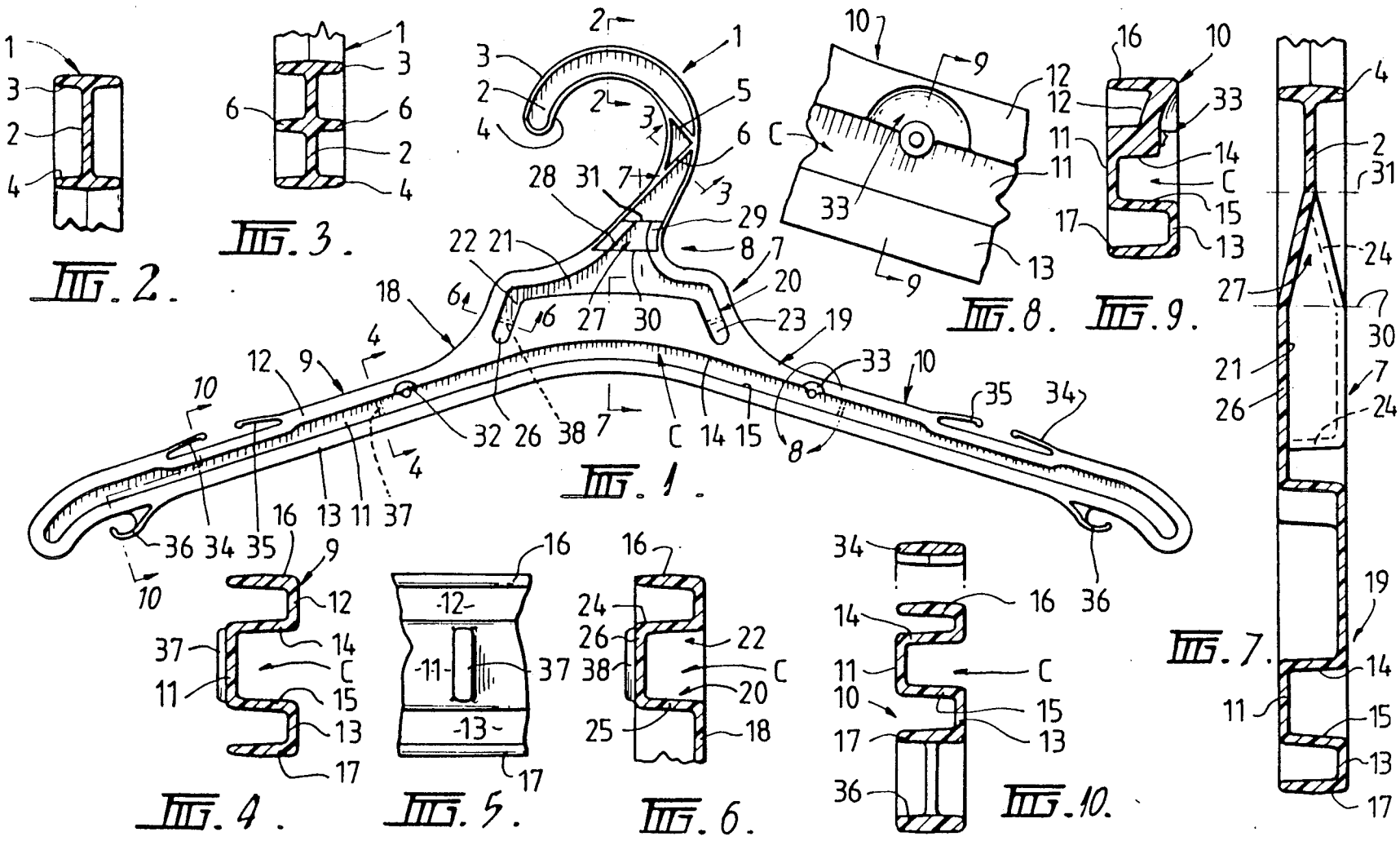
FIG. 1 is a front elevation of a moulded plastics garment hanger embodying the present invention.
FIGS. 2–4 are cross sectional end elevations of the hanger taken along the lines 2—2, 3—3 and 4—4 respectively in FIG. 1.
FIG. 5 is a fragmentary rear elevation of that part of the hanger shown in FIG. 4.
FIGS. 6 and 7 are cross-sectional end elevations taken along the lines 6—6 and 7—7 respectively in FIG. 1.
FIG. 8 is enlarged detail 8 taken from FIG. 1.
FIG. 9 is a sectional end elevation taken along the line 9—9 in FIG. 8.
FIG. 10 is a sectional end elevation taken along the line 10—10 in FIG. 1.

Referring firstly to FIG. 1 of the drawings, the hanger embodying the invention comprises a hook 1 having a I cross-sectional configuration comprising a central web 2 and flanges 3 and 4, as shown in FIG. 2 of the drawings. The hook is reinforced by integral ribs 5 and 6 which extend tangentially from the flange 4 to meet a point on the opposite flange 3 at the position shown in FIG. 1 of the drawings. It will be noted from FIG. 3 that the ribs 5 and 6 are formed on either side of the web 2 of the hook 1.

The hook 1 is joined to a shoulder region 7 by a throat region 8, which will be described further below, and the shoulder region is in turn connected to a pair of arms 9 and 10 of identical construction. Each arm 9, 10 has a cross-sectional configuration similar to the cross sectional configuration described in the aforementioned patent. As shown most clearly in FIG. 4 of the drawings, the cross sectional configuration comprises a central web 11 at the rear face of the arm, a pair of spaced webs 12 and 13 at the front face of the arm connected to the first web by connecting webs 14 and 15, and a pair of flanges 16 and 17 extending from the extremities of the webs 12 and 13 towards the rear face of the arm. The above described cross sectional configuration differs from the cross-sectional configuration described in the aforementioned patent in that the ejection angle of the webs 14 and 15 and the flanges 16 and 17 is reduced from about 8° to about 3° and the thickness of the section is reduced from about 1.1 mm to about 0.8 mm. The reduction in the ejection angle considerably strengthens the arm sections and enables the reduction in thickness while still increasing the strength of the arms.

It will be noted from FIG. 1 of the drawings that the central channel C defined by the webs 11, 14 and 15 continues from one arm to the other along a path which is disposed below the upper transition regions 18 and 19 between the shoulder region 7 and the arms 9 and 10. It will noted from FIG. 1 of the drawings of the aforementioned patent 544211 that this channel intersects and extends up into the shoulder region of the hanger described in the patent thereby creating a region of weakness in the transition regions between the shoulder region and the arms of the hanger.

The shoulder region 7 is reinforced by an inverted generally U-shaped channel 20 having a base portion 21 and splayed leg portions 22 and 23 extending towards the reinforcing channel extending between the arms 9 and 10. The ends of the legs 22 and 23 terminate before reaching the aforementioned reinforcing channel thereby leaving an uninterrupted planar region extending across the upper transition regions 18 and 19. As shown in FIG. 1, in the presently preferred embodiment, this region is approximately 5 mm wide in each case.

As shown in FIG. 6 of the drawings, the flange 16 of each arm continues up into the shoulder region 7, running parallel to the sides 24 and 25 of the legs 22 and 23 of the channel 20 which are connected by the web 26.

The base 21 of the channel 20 opens into an upwardly extending continuation 27 of the channel 20 which extends into the throat region 8 of the hook 1. The continuation 27 is confined on either side by webs 28 and 29 connecting the continuation of the outer flanges 16 of the arms 9 and 10 and the extensions of the connecting webs 24 of the channel 20. The flanges 16 eventually meet the outer and inner flanges 3 and 4 of the hook 1 while the continuation 27 of the channel 20 connects with the web 2 of the hook 1 in the manner shown in FIG. 7 of the drawings. It will be noted from this figure that the web or floor 26 of the channel 20 is deflected towards the position of the central web 2 from the line 30 to the line 31 while the web 24 extends inwardly from the line 30 to the line 31 where it also meets the web 2.

As shown in FIGS. 8 and 9 of the drawings, the front face of the arms of the hanger are slightly modified at the positions 32 and 33 to allow for two moulding gates to be used in the moulding of the hanger. The advantages of using two moulding gates is described above. While the section of each arm at the positions 32 and 33 is shown in FIGS. 6 and 6*a* to be modified, further work is progressing in this regard to avoid the need to modify the face of the hanger at these points.

As shown in FIGS. 1 and 10 of the drawings, the arms of the hanger are provided with garment strap engaging elements 34 and 35 at the upper portion of the arms 9 and 10 and with further strap engaging hooks 36 at the lower portions of the arms 9 and 10. It will be noted from FIG. 10 that the cross section of the arms 9 and 10 is modified at these positions.

As shown in most clearly in FIGS. 4 to 6 of the drawings, the rear faces of the webs 11 and 26 are preferably formed with locating lugs 37 and 38 which are dimensioned to engage the channels defined by the connecting webs 14 and 15 and the channel 20 respectively to facilitate positive location of adjacent hangers when they are stacked one on top of each other.

Figure 11:
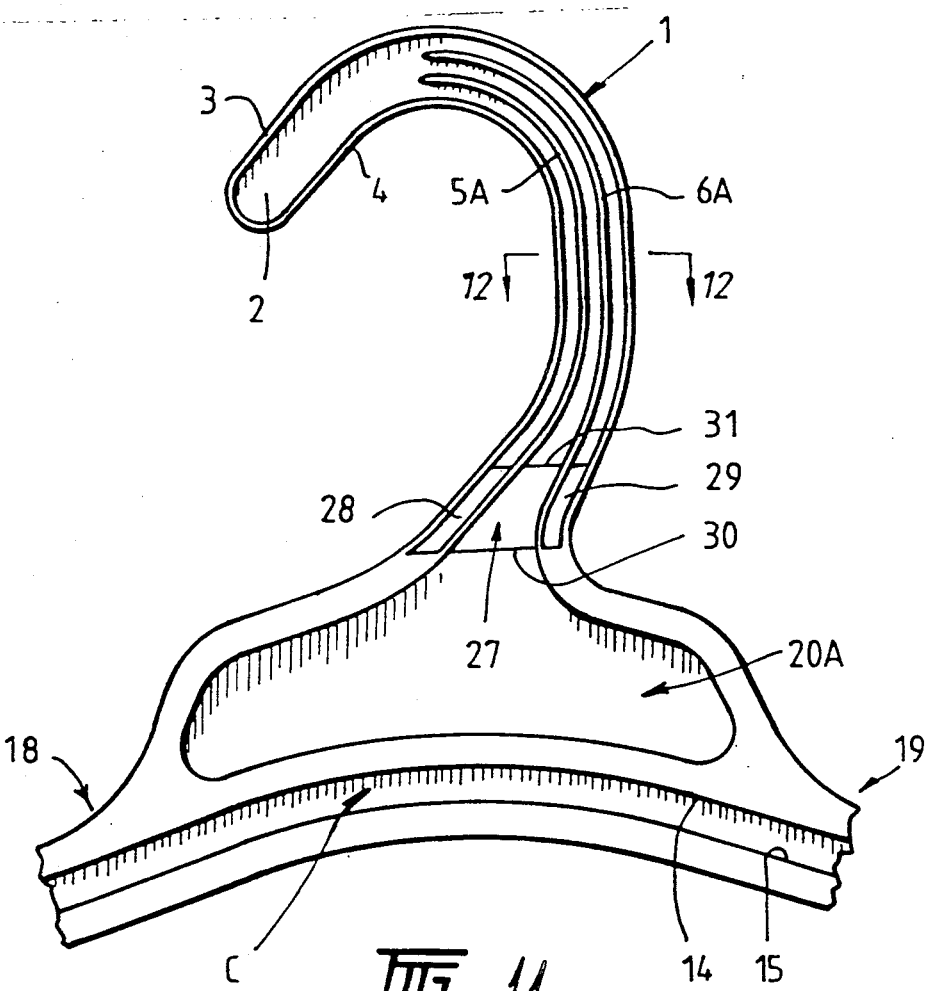
FIG. 11 is a fragmentary front elevation of a second embodiment of the invention.
Figure 12:
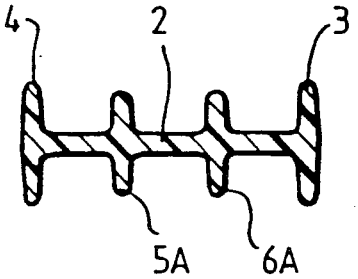
FIG. 12 is a sectional end elevation taken along the line 12—12 in FIG. 11.

Referring now to the modification shown in FIGS. 11 and 12 of the drawings, the principal differences in this embodiment are that the U-shaped channel 20 is replaced by an extended depressed region 20A having a greater similarity in shape to the equivalent region of the hanger shown in our earlier Patent 544211 and U.S. Pat. No. 283,854. Also, the hooked configuration is slightly modified in shape and the reinforcing ribs 5 and 6 of the previous embodiment are replaced by ribs 5A and 6A which follow the configuration of the hook. The structure of the hanger is otherwise substantially identical to the structure of the preceding embodiment and the same reference numerals have been used to identify similar parts. It will be noted that the central channel C extending from one arm 9 to the other 10 is isolated from the depressed region 20A to ensure that the strength of the hanger in the transition regions 18 and 19 is not compromised.

While two preferred embodiments of the invention have been described in detail above, it should be appreciated that the specific design and dimension features conveyed by the drawings should not be taken as limiting the invention in any way.

I claim:

1. A molded plastic garment hanger comprising a hook, a shoulder region extending from the hook, and arms extending from said shoulder region, said shoulder region having a cross-sectional configuration which reinforces said shoulder region, said arms each having at least a U-shaped cross-sectional configuration to increase the strength of the arms, said cross-sectional configuration extending from one arm to the other along a continuous or uninterrupted path which extends below the shoulder region and is separated therefrom by a generally planar region extending continuously below said shoulder region to the arms of the hanger; wherein said cross-sectional configuration of said shoulder region includes a depressed region having a floor portion across the shoulder region; said molded plastic garment hanger further having a front edge and a rear edge; said hook having a central web and reinforcing flange means, said floor portion of said depressed region extending continuously at an angular orientation from the front edge plane towards the rear edge plane from said depressed region to a central web of said hook so as to reduce regions of weakness between said shoulder region and said hook.

2. The hanger as claimed in claim 1, wherein said planar region has a width of about 3 to 7 mm.

3. The hanger as claimed in claim 2, wherein said planar region has a width from about 5 mm.

4. The hanger as claimed in claim 1, wherein each said hanger arm has a central U-shaped channel, webs extending outwardly from each side wall of the channel and flanges extending from the edges of said webs in a direction substantially parallel to the sides of said channel.

5. The hanger as claimed in claim 4, wherein said flanges are formed with an ejection angle in the range of about 2°-5°.

6. The hanger as claim in claim 5, wherein said angle is about 3°.

7. A molded plastic garment hanger comprising a hook, a shoulder region extending from the hook, and arms extending from said shoulder region, said shoulder region having a cross-sectional configuration which reinforces said shoulder region and includes a depressed region having a floor portion, said hook having a central web and reinforcing flange means, said molded plastic garment hanger having a front edge and rear edge; said floor portion of said depressed region extending in a smooth angular manner from the front edge plane towards the rear edge plane from said depressed region to the central web of said hook so as to reduce regions of weakness between said shoulder region and said hook.

* * * * *